United States Patent [19]

Homma

[11] Patent Number: 4,738,130

[45] Date of Patent: Apr. 19, 1988

[54] STRUCTURE FOR MOUNTING MANDRELS IN TUBE EXPANDING APPARATUS

[75] Inventor: Kensaku Homma, Osaka, Japan

[73] Assignee: Kyoshin Kogyo Kabushiki Kaisha, Osaka, Japan

[21] Appl. No.: 923,181

[22] Filed: Oct. 27, 1986

[30] Foreign Application Priority Data

Nov. 8, 1985 [JP] Japan ..... 60-286787
Dec. 18, 1985 [JP] Japan ..... 60-172752

[51] Int. Cl.[4] ..... B21D 37/04

[52] U.S. Cl. ..... 72/481; 72/462; 279/41 R; 279/93; 279/46 R

[58] Field of Search ..... 72/481, 462, 368, 370, 72/373, 289, 287; 29/157.36; 279/6, 77, 81, 41 R, 1 TE, 84, 93, 95, 41 A, 46 A, 46 R; 83/698, 700; 403/348, 349, 353, 371, 361

[56] References Cited

U.S. PATENT DOCUMENTS 2,219,907 10/1940 Ross ..... 279/93
3,384,386 5/1968 Ward et al. ..... 279/93
3,916,758 11/1975 Ashbrook ..... 279/46 R
4,669,742 6/1987 Broszukat ..... 279/41 A

FOREIGN PATENT DOCUMENTS 59-174234 10/1984 Japan .
60-003927 1/1985 Japan .

*Primary Examiner*—Robert L. Spruill
*Assistant Examiner*—David B. Jones
*Attorney, Agent, or Firm*—Birch, Stewart, Kolasch & Birch

[57] ABSTRACT

A structure for mounting mandrels in a tube expanding apparatus comprising a horizontal mounting plate fixed to the underside of a vertically movable slide and having a plurality of passage holes through which the mandrels suspendingly extend. The structure comprising a cylindrical holder non-fixedly provided on the mounting plate above each passage hole and having an internal gripping space for holding an upper region of each mandrel. The holder comprising a pair of cylinder halves movable toward and away from each other. A contractive rubber ring being fitted around the holder to force the cylinder halves toward each other into a joined state. The upper region of the mandrel being provided with a diametrically reduced, eccentric portion surrounded by an engaging groove. With one of the cylinder halves being internally formed with an arcuate projection which is selectively engageable with and disengageable from the engaging groove in response to the rotation of the mandrel relative to the holder.

11 Claims, 9 Drawing Sheets

STRUCTURE FOR MOUNTING MANDRELS IN TUBE EXPANDING APPARATUS

BACKGROUND OF THE INVENTION

1. Field of the Invention

This invention relates to a tube expanding apparatus of the type which has a plurality of mandrels to be forced into a plurality of tubes for simultaneously conducting diametrical expansion thereof, and more particularly to an improved structure for readily removably mounting such mandrels in a tube expanding apparatus.

2. Description of the Prior Art

In general, tube expanding apparatuses of the above described type comprise a slide which is vertically movable as guided along upright posts, and a horizontal mounting plate fixed to the underside of the slide and suspendingly supporting a plurality of mandrels, as disclosed for example in Japanese Patent Application Laid-open No. 59-174234 (Laid-open Oct. 2, 1984; Application No. 58-46731; Applicant: Kyoshin Kogyo Kabushiki Kaisha; Inventor: Kensaku HOMMA).

More specifically, in the tube expanding apparatus of the above Laid-open Japanese Application, the mounting plate has in its wall thickness a plurality of passage holes and a plurality of diametrically larger accommodating bores positioned coaxially above the respective passage holes in communication therewith. Each of the mandrels penetrates through each of the passage holes and has an enlarged head loosely housed in each of the accommodating bores, so that the mandrels are non-fixedly supported by the mounting plate in a suspending manner. An abutment plate having a plurality of through-holes or perforations in corresponding relation to selected ones of the mandrels is replaceably interposed between the slide and the mounting plate. The perforations have a diameter which is larger than the diameter of the enlarged mandrel heads. As a result, despite descent of the slide the selected ones of the mandrels are allowed to ascend through the perforations and thereby remain idle during a tube expanding operation, whereas the remaining ones of the mandrels are lowered together with the slide because of engagement of their respective heads with the underside of the abutment plate to conduct diametrical expansion of tubes therebelow.

When the abutment plate is replaced by another abutment plate which is differently perforated, it is possible to alter the arrangement of effective (non-idle) ones of the mandrels in accordance with the arrangement of tubes without requiring removal of certain ones of the mandrels per se. Thus, the non-fixed mounting of the mandrels on the mounting plate is advantageous in that the tube expanding apparatus becomes applicable to various tube arrangements by simple replacement of the abutment plate.

On the other hand, it is often necessary to remove each of the mandrels from the mounting plate as for example for replacement by a dimensionally different mandrel or for repair. However, the above Japanese Application fails to give any suggestion as to how to provide for such a possibility.

FIG. 13 of the accompanying drawings illustrates one possible arrangement for removable mounting of mandrels in a tube expanding apparatus similar to that of the above Japanese Application.

Referring now to FIG. 13, a horizontal mounting plate 100 which is fixed to the underside of an unillustrated slide has in its wall thickness a passage hole 101 for each penetrating mandrel 102 and a diametrically larger accommodating bore 103 located concentrically above the passage hole in communication therewith. The accommodating bore 103 loosely houses an enlarged head cap 104 attached to the upper end of the mandrel 102 by means of a clamping bolt 105. A horizontal abutment plate 106 is disposed above the mounting plate 100 to come into abutment with the head cap 104 for preventing upward displacement of the mandrel 102, whereby a tube (not shown) therebelow is diametrically expanded upon descent of the slide or the mounting plate 100. Alternatively, the abutment plate 106 may have a perforation 107 which is larger in diameter than the head cap 104, so that the mandrel 107 is allowed to rise freely through the perforation 107 for the purpose previously described, as indicated in phantom lines.

According to the arrangement of FIG. 13, the mandrel 102 is removable from the mounting plate 100 and the head cap 104 by loosening the clamping bolt 105. However, this arrangement necessitates an operator to climb above the mounting plate 100 to loosen the clamping bolt 105, consequently requiring a lot of time and labor.

Japanese patent application Laid-open No. 60-3927 (Laid-open Jan. 10, 1985; Application No. 58-111651; Applicant: Daikin Kogyo Kabushiki Kaisha; Inventor: Takashi MIYAGAWA) discloses three types of mandrel mounting structure which enable easy removal of each mandrel, and these three types will now be described below respectively with reference to FIGS. 14 to 16 of the accompanying drawings.

In a first type illustrated in FIG. 14, a mounting plate 200 has internally threaded holes 201 into which externally threaded upper ends 203 of mandrels 202 are screwed. Thus, the mandrels 202 can be removed from the mounting plate 200 by simply turning them from below.

Despite simplicity in the removal of the mandrels 202, the first type has a vital disadvantage in that because the mandrels 202 are fixed to the mounting plate 200 in a mounted condition, there is no possibility for the mandrels 202 to move upward relative to the mounting plate 200 even if such is desired. Another drawback with the first type is that the mandrels 202 may be unexpectedly removed from the mounting plate 200 due to repetitive application, to the mandrels, of a rotational force during a tube expanding operation.

According to a second type illustrated in FIG. 15, a mounting plate 300 has an insertion hole 301 for receiving the upper end of each mandrel 302. The mounting plate 300 further has a lateral hole 303 into which is slidably fitted a spring biased engaging member 304. The upper end of the mandrel 302 is provided with a recess 305 with which the engaging member 304 releasably engages When the mandrel 302 is rotated through more than a specified angle, the engaging member 304 retracts into the lateral hole 303 to allow subsequent removal of the mandrel from the mounting plate 300.

The second type also has the same drawbacks as the first type since the mandrel 302 is fixed to the mounting plate 300 in a mounted condition. Further, the problem of unexpected removal of the mandrel 302 is more serious in the second type than in the first type because even a slight rotation of the mandrel can cause complete removal thereof.

In a third type shown in FIG. 16, a mounting plate 400 has a blind hole 401 for receiving the upper end of each mandrel 402. The blind hole 401 is formed with a surrounding annular groove 403 in which is fitted a radially outer half of a rubber ring 404. The upper end of the mandrel 402 is also provided with an annular groove 405 into which a radially inner half of the rubber ring 404 is fitted. Thus, the upper end of the mandrel 402 can be forced into and out of the rubber ring 404 due to elastic deformation thereof.

Similarly to the first and second types, the mandrel 402 of the third type is incapable of moving upward relative to the mounting plate 400. Further, because the rubber ring 404 provides an extremely limited retaining force, the mandrel 402 may fall off due simply to the weight of its own. Moreover, the mandrel 402, once forced into its counterpart tube (not shown) for diametrical expansion, will not return to its original raised position if the frictional force between the mandrel and the tube exceeds the retaining force of the rubber ring 404.

SUMMARY OF THE INVENTION

It is, therefore, an object of the present invention to provide a mandrel mounting structure for a tube expanding apparatus which, while maintaining selective upward movability of individual mandrels, enables ready removal of the mandrels when required.

According to the present invention, there is provided a structure for mounting mandrels in tube expanding apparatus comprising a vertically movable slide, and a horizontal mounting plate fixed to the underside of the slide and having a plurality of passage holes through which the mandrels suspendingly extend, the structure comprising: a cylindrical holder non-fixedly provided on the mounting plate above each passage hole and having an internal gripping space for holding each mandrel in an upper end region thereof; the holder comprising a pair of cylinder halves movable toward and away from each other and each having a pair of joining end walls; elastic means for exerting a contractive force on the cylinder halves so that the cylinder halves are moved toward each other into a joined state; the mandrel being provided in the upper end region with cam means which acts to move the cylinder halves away from each other against the contractive force of the elastic means when the mandrel is rotated relative the holder; and one of the cylinder halves being internally provided with engaging means which engages with the mandrel at the cam means but disengages therefrom when the cylinder halves are moved away from each other.

Other objects, features and advantages of the present invention will become apparent from the following detailed description.

DESCRIPTION OF THE PREFERRED EMBODIMENTS

Figure 1:
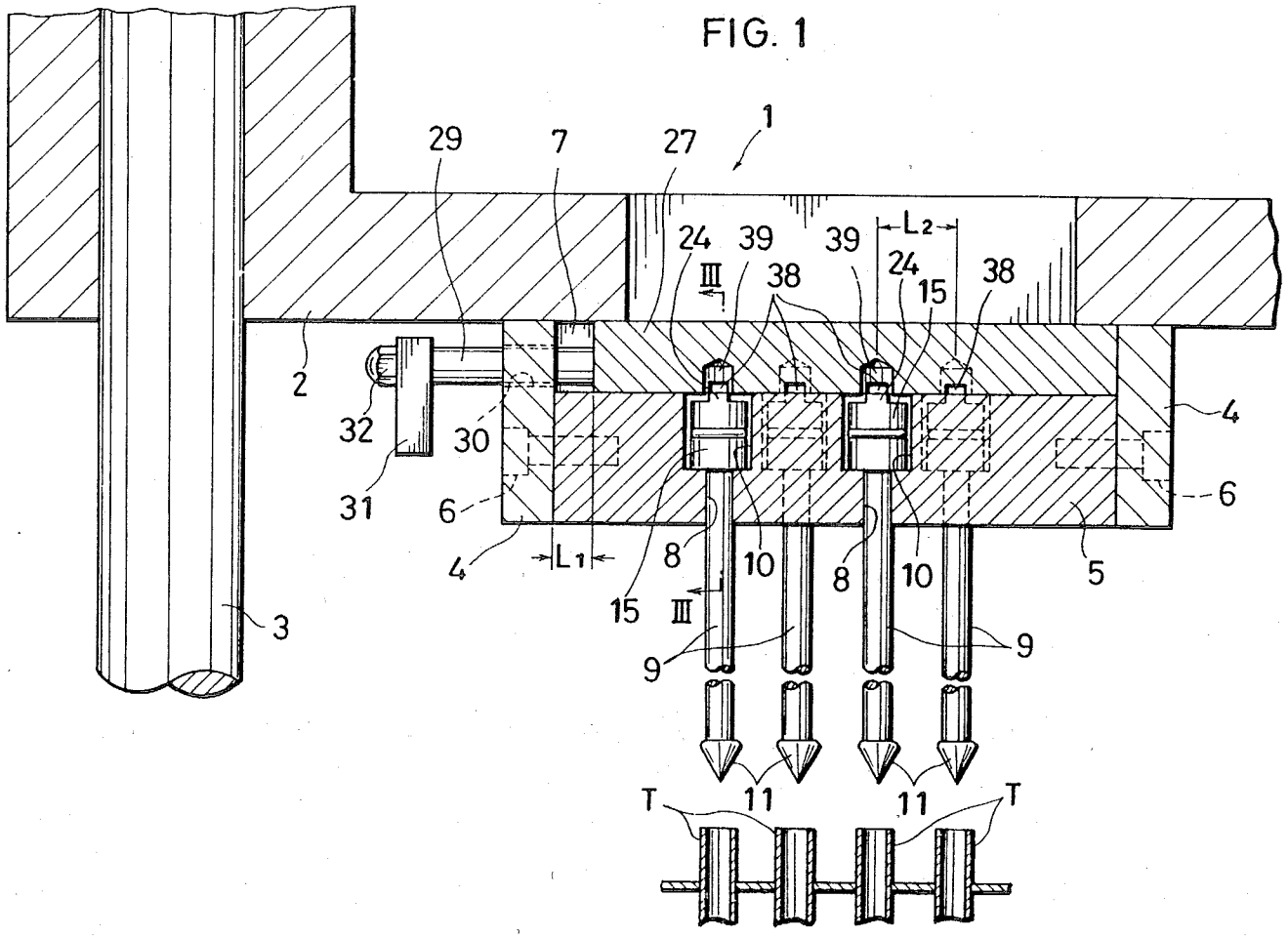
FIG. 1 is a fragmentary section, with parts broken away, showing a mandrel mounting structure in a tube expanding apparatus according to the invention.
Figure 2:
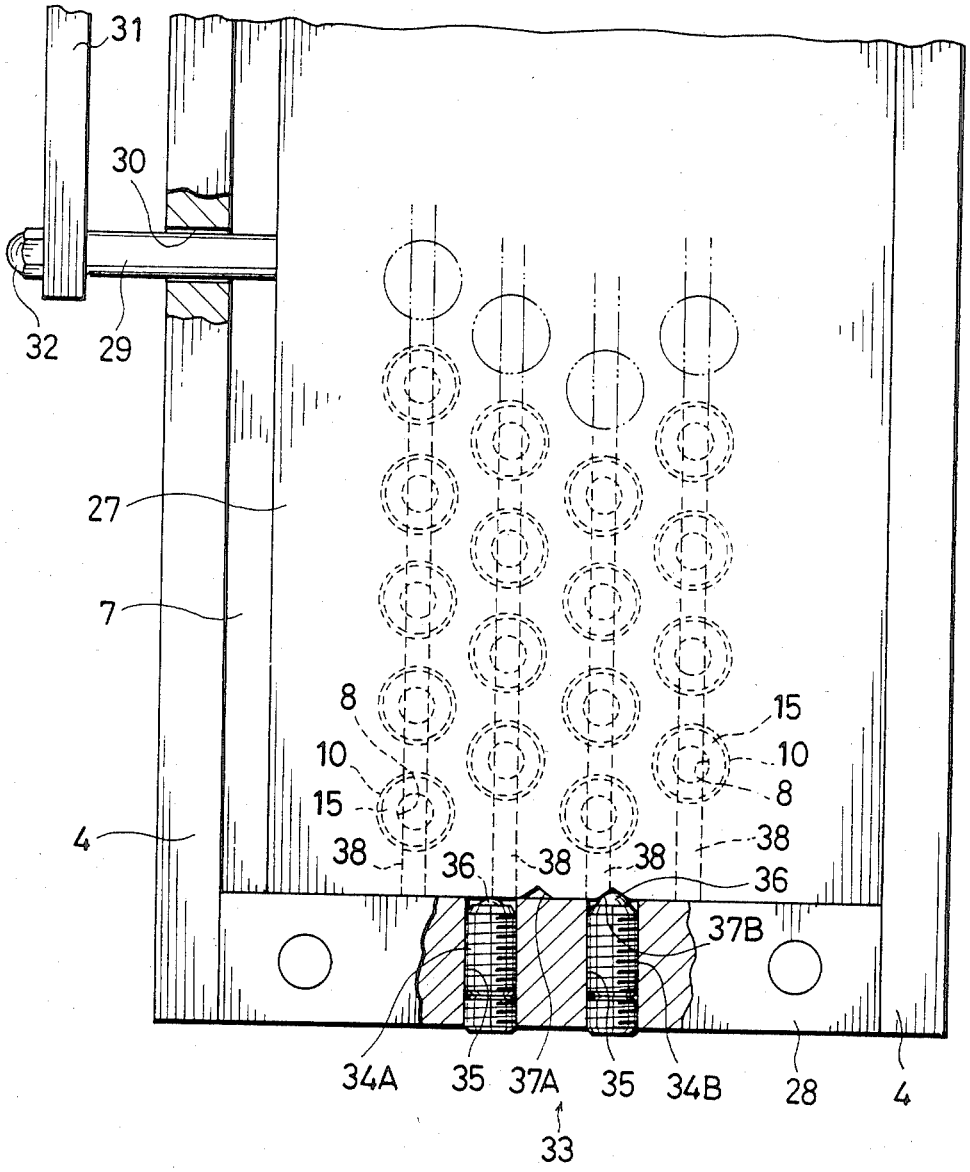
FIG. 2 is a top plan view, partly broken away, showing the mandrel mounting structure on a somewhat enlarged scale.

Referring now to FIGS. 1 and 2, a tube expanding apparatus generally represented by reference numeral 1 comprises a slide 2 which is moved up and down along a plurality of upright posts 3 (only one illustrated) by a hydraulic or pneumatic drive (not shown), conventionally. A pair of support plates 4 are mounted to the underside of the slide 2, and a horizontal mounting plate 5 is interposed between and fixed to the support plates 4 by means of bolts 6 to define an accommodating space 7 between the mounting plate 5 and the slide 2.

According to the illustrated example, the mounting plate 5 has four rows of passage holes 8 through which a plurality of rod-form mandrels 9 extend vertically downward. The passage holes in each row are arranged at a constant spacing and in staggered relation to the passage holes in an adjacent row, as is apparent from FIG. 2. Each of the passage holes 8 communicates with a diametrically larger accommodating bore 10 formed concentrically thereabove in the wall thickness of the mounting plate 5.

Figure 3:
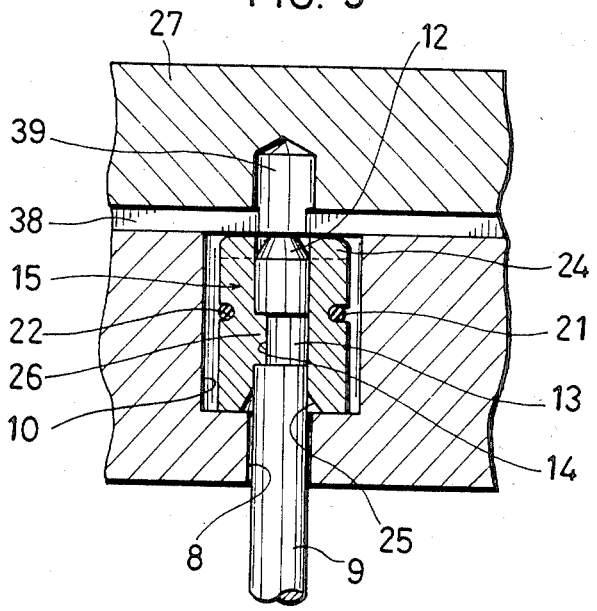
FIG. 3 is an enlarged fragmentary section taken on lines III—III in FIG. 1.
Figure 9:
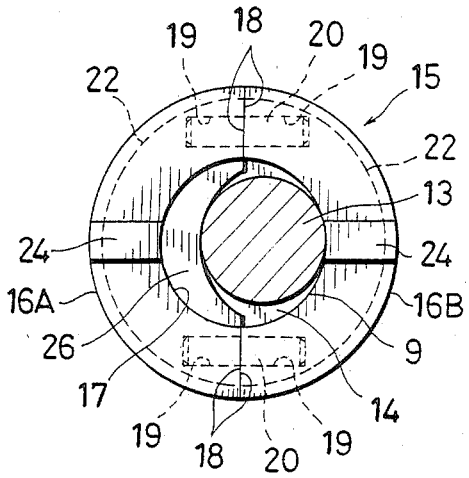
FIG. 9 is a top plan view of the mandrel holder in the contracted state.
Figure 10:
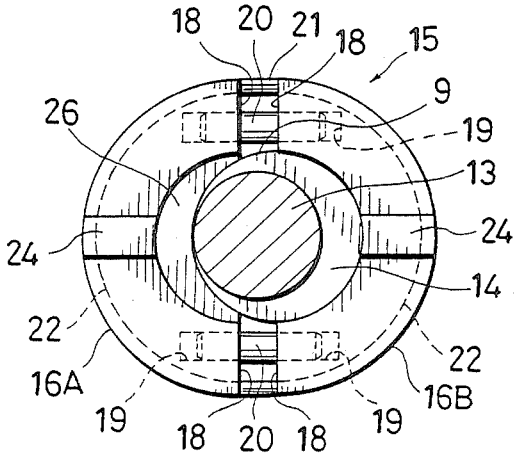
FIG. 10 is a top plan view of the mandrel holder in the expanded state.

Each of the mandrels 9 has an enlarged, tube expanding tip 11 at the lower end thereof and a tapered head 12 (see FIG. 3) at the upper end. The mandrel has a normal diameter which is substantially equal to or slightly less than the diameter of the passage hole 8. However, a part of the mandrel close to the tapered head 12 is cut away to provide a diametrically reduced, eccentric cam portion 13 substantially surrounded by an engaging groove 14, as illustrated in FIGS. 3, 9 and 10. The purpose of the cam portion 13 and the engaging groove 14 will be described hereinafter, and it now suffices to mention that a cross-sectional circle provided by the cam portion 13 is internally tangent to a normal diameter cross-sectional circle of the mandrel 9

A cylindrical holder 15 is loosely housed in each of the accommodating bores 10 of the mounting plate 5 to grip the upper end portion of a corresponding mandrel 9, so that the mandrel is suspendingly supported from the mounting plate. The height of the holder may be equal to or slightly smaller than the depth of the accommodating bore.

As shown in FIGS. 4, 5, 9 and 10, the holder 15 comprises a pair of separate cylinder halves 16A and 16B which in a joined state define an internal gripping space 17 for closely receiving the upper end portion of the mandrel 9. Each joining end wall 18 of the cylinder halves is formed with a pair of guide holes 19 into which a pair of guide rods 20 slidably fit, whereby the cylinder halves are movable toward and away from each other in a guided manner.

Figure 4:
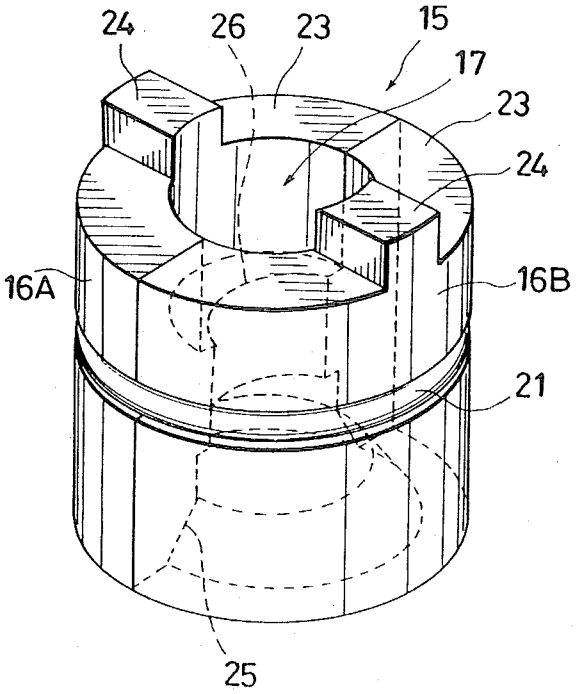
FIG. 4 is an enlarged perspective view showing an example of mandrel holder in a contracted state.

Under normal operating condition, the cylinder halves 16A and 16B are held in the joined state of FIGS. 4 and 9 by the contractive action of a rubber ring 21 which is fitted in external circumferential grooves 22 of the respective cylinder halves.

The cylinder halves are provided on their respective top end walls 23 with a pair of upwardly directed central projections 24 for the purpose to be described hereinafter. On the other hand, the respective bottom end walls of the cylinder halves are internally tapered to provide a conical guide surface 25 when the cylinder halves are joined together, as illustrated in FIG. 3.

One of the cylinder halves, i.e., the cylinder half 16A is internally formed with an inwardly directed, generally arcuate projection 26 which is engageable in the engaging groove 14 of the mandrel 9, so that the mandrel is prevented from axially displacing relative to the holder 15 when the latter is fully joined or closed. The curvature of the arcuate projection 26 at the inner circumference thereof is equal to that of the mandrel 9 at the normal diameter portion thereof.

Within the accommodating space 7 between the mounting plate 5 and the slide 2 is disposed a horizontal abutment plate 27 which is slidable within a limited range as guided by a pair of guide plates 28 (only one shown in FIG. 2) fixed to the support plates 4 and to the slide 2. To enable the slidable movement of the abutment plate 27 from outside, the abutment plate is provided on one side thereof with an operating rod 29 penetrating through a central opening 30 of the adjoining support plate 4 for connection to a handle 31 by means of a bolt 32.

According to the illustrated example, the distance L1 traveled by the abutment plate 27 is set half the interval L2 between two adjacent rows of the passage holes 8.

The slidable abutment plate 27 is also lockable at two predetermined positions. For this purpose, there is provided a locking assembly 33 which comprises a pair of hollow threaded shafts 34A and 34B each screwed in a threaded bore 35 of one guide plate 28 and having a ball 36 spring-biased toward the abutment plate 27, and a pair of V-shaped recesses 37A and 37B each formed in a corresponding lateral surface of the abutment plate 27 for disengageably receiving the ball 36 of the corresponding threaded shaft 34A. If required, a similar locking assembly may additionally be arranged with respect to the other unillustrated guide plate 28.

The underside of the abutment plate 27 is provided with four parallel longitudinal grooves 38 extending over the entire length of the abutment plate 27 in corresponding relation to the rows of passage holes 8. The width of each groove 38 is substantially equal to or slightly larger than the width of the upward projections 24 of the holder 15, so that the upward projections 24 are fittable into the groove 38 for the purpose to be described hereinafter.

The underside of the abutment plate 27 is further provided along the longitudinal grooves 38 with four rows of blind holes 39 which are identical in arrangement to the rows of passage holes 8. The diameter of the blind holes 39 is substantially equal to or slightly larger than the normal diameter of the mandrels 9.

Figure 6:
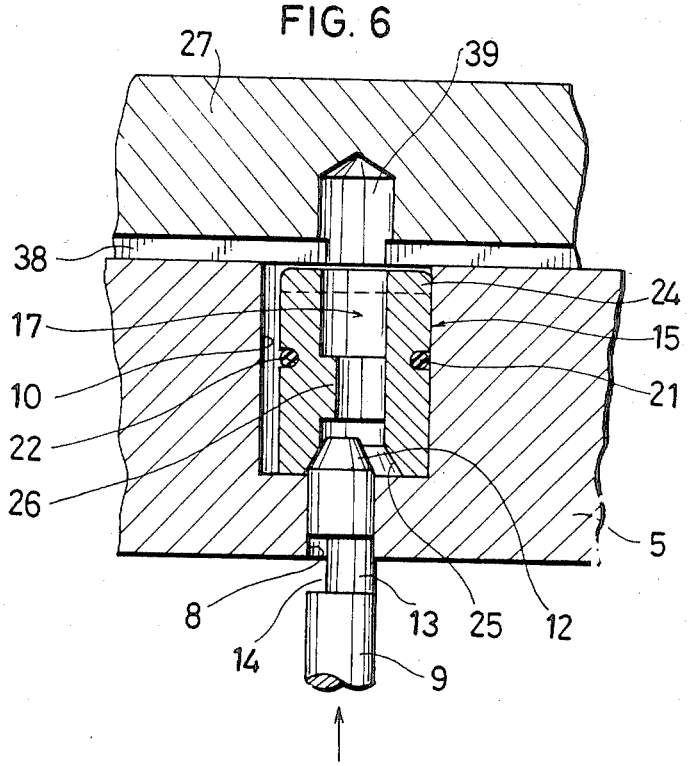
FIG. 6 is a view similar to FIG. 3 but showing a mandrel which is about to be inserted into the holder.
Figure 5:
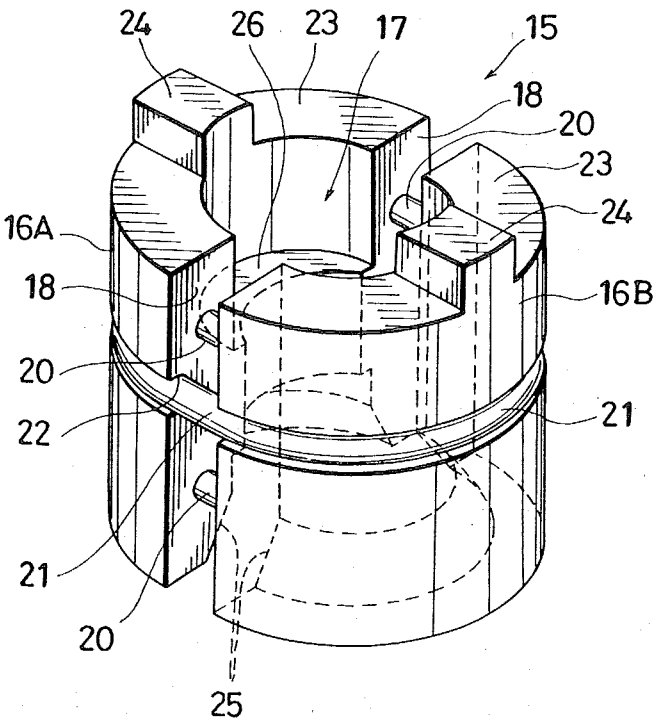
FIG. 5 is also an enlarged perspective view showing the mandrel holder in a fully expanded state.

To connect a mandrel 9 to a corresponding holder 15, the tapered head 12 of the mandrel 9 is first inserted from below through a corresponding passage hole 8 into the internal gripping space 17 of the holder 15, as shown in FIG. 6. At this time, the tapered head 12 of the mandrel 9 and the conical guide surface 25 of the holder 15 cooperate to smoothly guide the upper end portion of the mandrel 9 into the gripping space 17 of the holder 15 even if the holder 15 is located eccentrically relative to the accommodating bore 10. Upon passage of the tapered head 12 of the mandrel 9 past the arcuate projection 26 of the holder 15, the cylinder halves 16A and 16B of the holder 15 move away from each other against the contractive force of the rubber ring 21, as shown in FIG. 5. As a result, the gripping space 17 of the holde 15 is expanded enough to allow complete fitting and anchoring of the mandrel upper end portion in the holder 15 upon subsequent contraction thereof by the elastic restoration of the rubber ring 21. It is to be noted in this connection that an angular deviation of the mandrel 9 relative to the holder 15 is corrected automatically because the elastic contraction of the rubber ring 21 tends to relatively rotate the mandrel 9 to its correct angular position in the holder 15 due to the eccentricity of the cam portion 13.

Figure 7:
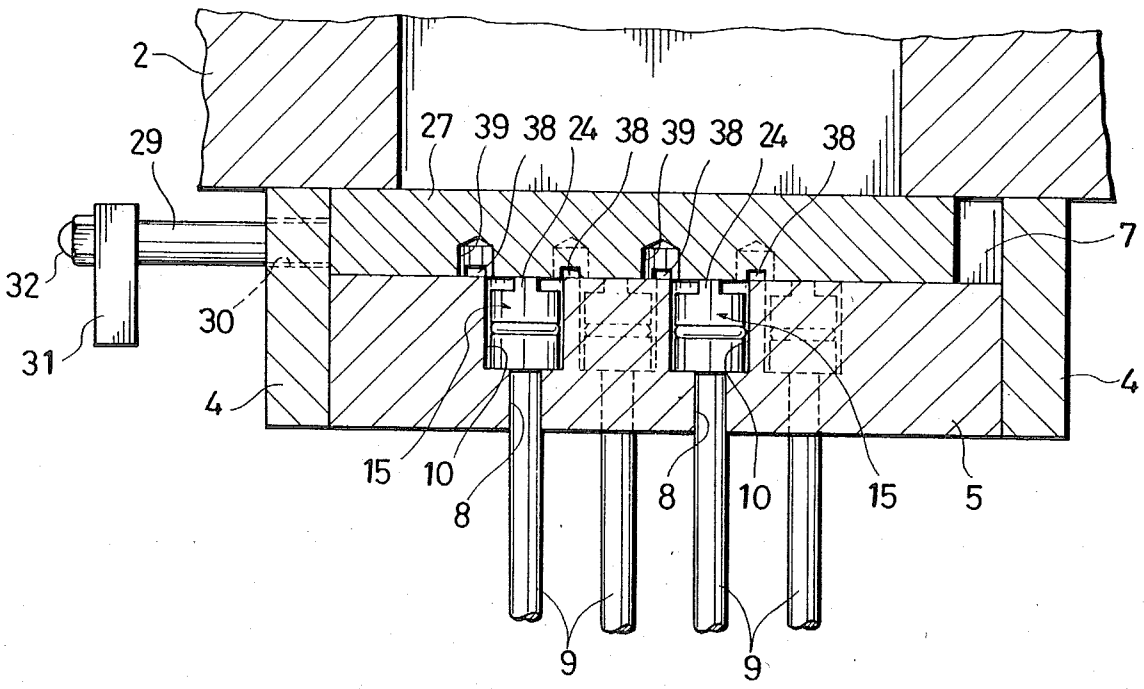
FIG. 7 is a view similar to FIG. 1 but showing the tube expanding apparatus in a state ready for tube expanding operation.

In tube expanding operation of the apparatus 1, the operating rod 29 is pulled outward by means of the handle 31 to move to the position shown in FIG. 7 and locked there by the engagement of the ball 36 of the threaded shaft 34A with the V-shaped recess 37A (see FIG. 2). In this position, all of the holders 15 come into rotatable abutment with the underside of the abutment plate 27 clear of the longitudinal grooves 38 and the blind holes 39. Thus, when the slide 2 is lowered, all of the mandrels 9 are also lowered, with the result that their respective tips 11 carry out intended diametrical expansion of tubes T of e.g. a finned heat exchanger.

During the above described tube expanding operation, a rotational force may be unexpectedly applied to the mandrel 9. Such an unexpected rotational force, however, will not result in unintended expansion of the holder 15 because the holder 15, which is in rotatable contact with the abutment plate 27, can rotate with the mandrel 9. Thus, it is possible to reliably prevent accidental disconnection of the mandrel 9 from the holder 15 due to the unintended expansion of the holder.

Figure 8:
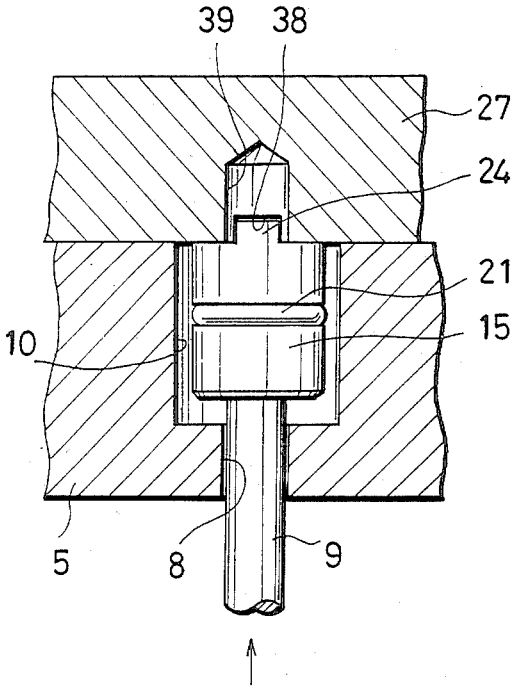
FIG. 8 is a front sectional elevation illustrating the mandrel holder as lifted for mandrel removal.

To intentionally disconnect a desired one of the mandrels 9 from a corresponding one of the holders 15 for replacement or repair for example, the operating rod 29 is pushed in to move the abutment plate 27 to the position shown in FIGS. 1 and 2 and locked there by the engagement of the ball 36 of the threaded shaft 34B with the V-shaped recess 37B. In this state, the mandrel 9 and the holder 15 are located immediately under the corresponding longitudinal groove 38 and blind hole 39. The mandrel 9 is then lifted manually to engage the upward projections 24 of the holder 15 into the longitudinal groove 38, as illustrated in FIG. 8. Upon subsequent rotation of the mandrel 9 through 180 degrees relative to the holder 15 which is now prevented from its own rotation, the cam portion 13 of the mandrel 9 initially taking the position shown in FIG. 9 eccentrically rotates to assume the diametrically opposite position shown in FIG. 10 while always contacting the arcuate projection 26 of the holder 15, consequently forcing the cylinder halves 16A and 16B of the holder 15 away from each other against the contractive action of the rubber ring 21 and disengaging the arcuate projection 26 from the engaging groove 14. Thus, the mandrel 9 can be drawn out of the holder 15 by pulling down the mandrel.

During the above described mandrel disconnecting operation, it is not always certain that the mandrel 9 is rotated exactly through 180 degrees particularly because such rotation of the mandrel 9 is conducted manually. This causes the following problem.

If the mandrel 9 is pulled down when it is rotated through less than or over 180 degrees relative to the holder 15, the mandrel 9 will not come out of the holder 15 due to insufficient expansion of the holder 15 as well as due to partial engagement of the arcuate projection 26 with the engaging groove 14. Despite such unsuccessful operation, the holder 15 with its upward projections 24 out of engagement with the longitudinal groove 38 will spontaneously rotate relative to the mandrel 9 (now manually held) to resume the state shown in FIG. 9 for the reason previously described in connection with the mandrel connecting operation. Thus, the mandrel disconnecting operation must be reconducted from the very start, meaning loss of time and labor.

The blind hole 39 of the abutment plate 27 serves to eliminate the above discussed problem. More specifically, the blind hole 39 enables the mandrel 9 to be pushed up thereinto to confirm whether the holder 15 is sufficiently expanded to allow subsequent downward withdrawal of the mandrel 9 from the holder 15. During such confirmation, the upward projections 24 of the holder 15 are kept in engagement with the longitudinal groove 38 to prevent unexpected spontaneous rotation of the holder 15. Thus, the mandrel 9 can be finely adjusted in relative rotational position when it fails to fit into the blind hole 39.

By disconnecting or removing a required number of mandrels 9, it is also possible to change mandrel arrangement pattern in accordance with a change in the arrangement of tubes requiring diametrical expansion.

Figure 11:
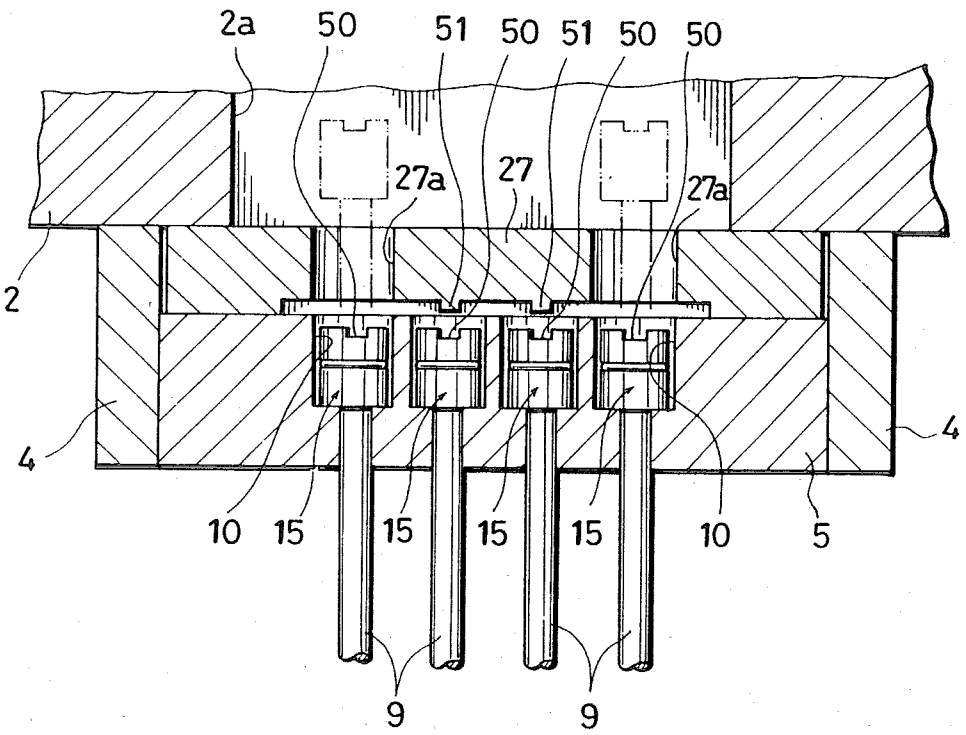
FIG. 11 is a view similar to FIG. 1 but showing a modification of the invention.
Figure 12:
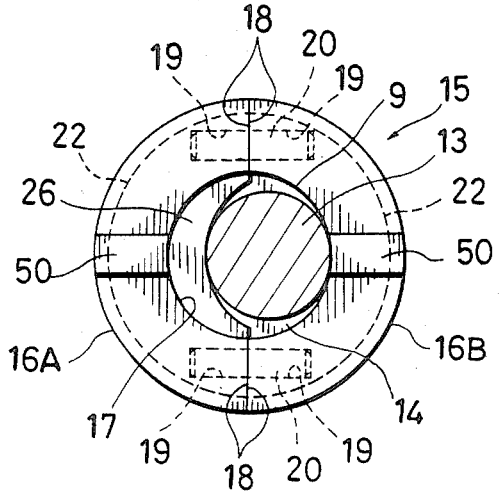
FIG. 12 is a top plan view of a modified mandrel holder.
Figure 13:
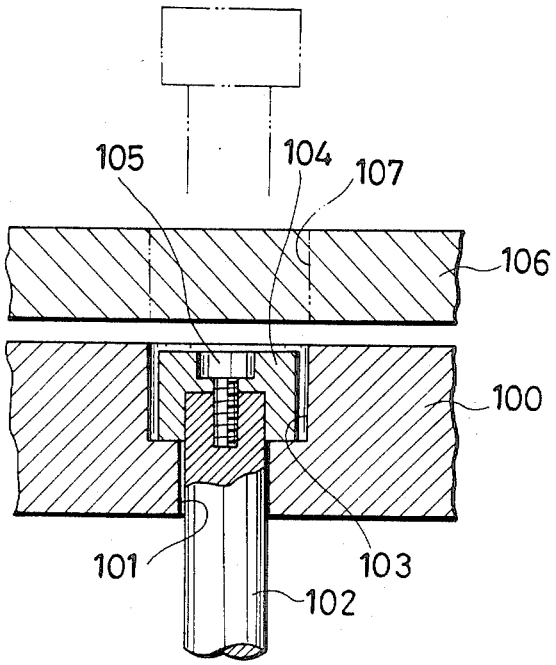
FIG. 13 Prior Art
FIGS. 13 to 16 are views in section showing four examples of prior art mandrel mounting structure.
Figure 14:
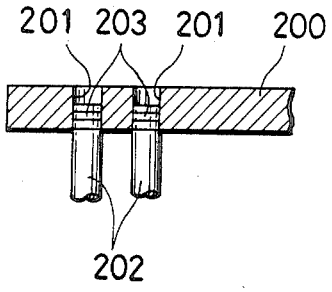
FIG. 14 Prior Art
Figure 15:
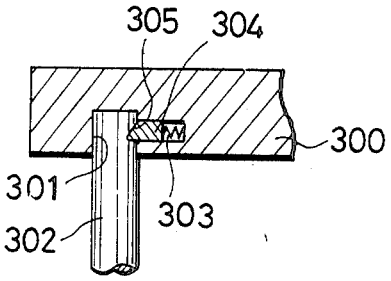
FIG. 15 Prior Art
Figure 16:
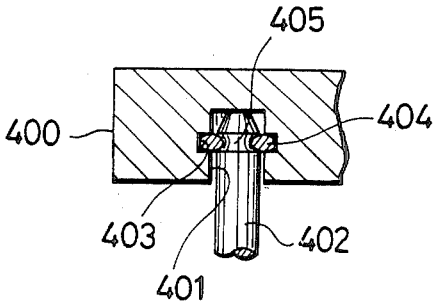
FIG. 16 Prior Art

FIGS. 11 and 12 represent a modification of the present invention in which each of holders 15 arranged in four rows is formed on its top wall with a pair of diametrically opposite radial grooves 50, whereas the underside of an abutment plate 27 is provided with a pair of longitudinal projections 51. Each of the longitudinal projections 51 comes into engagement with the radial grooves 50 of each holder 15 immediately thereunder when the holder 15 is raised for intentional disconnection of the corresponding mandrel 9.

According to the modification of FIGS. 11 and 12, the abutment plate 27 has through-holes 27*a* for allowing all of the holders 15 in the two outer rows and their associated mandrels 9 to ascend through the through-holes 27*a* as well as through a central opening 2*a* of the slide 2, as indicated in phantom lines. As a result, these mandrels are brought out of tube expanding operation. On the other hand, the mandrels 9 in the inner two rows remain effective for tube expansion. Thus, the use of such an abutment plate is advantageous in providing an effective mandrel arrangement pattern adapted to the arrangement of tubes without manually disconnecting a number of mandrels. It is of course possible to employ a non-perforated or differently perforated abutment plate depending on a particular arrangement of tubes requiring diametrical expansion.

The invention being thus described, it will be obvious that the same may be varied in many ways. For instance, the cam portion 13 of each mandrel 9 may be provided in the form of a radial projection which is engageable with and disengageable from a circumferential groove on the inner surface of the holder 15 (one of the cylinder halves) by the rotation of the mandrel accompanied by expansion and contraction of the holder. Further, the rubber ring 21 may be replaced by a metallic split ring. Such variations are not to be regarded as a departure from the spirit and scope of the invention, and all such modifications as would be obvious to those skilled in the art are intended to be included within the scope of the appended claims.

We claim:

1. A structure for mounting mandrels in tube expanding apparatus comprising a vertically movable slide, and a horizontal mounting plate fixed to the underside of said slide and having a plurality of passage holes through which said mandrels suspendingly extend, said structure comprising:

a holder non-fixedly provided on said mounting plate above each passage hole and having an internal gripping space for holdng each mandrel in an upper end region thereof;

said holder comprising a pair of cylinder halves movable toward and away from each other and each having a pair of joining end walls;

elastic means for exerting a contractive force on said cylinder halves so that said cylinder halves are moved toward each other into a joined state;

said mandrel being provided in said upper end region with cam means which acts to move said cylinder halves away from each other against the contractive force of said elastic means when said mandrel is rotated relative to said holder;

one of said cylinder halves being internally provided with engaging means which engages with said mandrel at said cam means but disengages therefrom when said cylinder halves are moved away from each other;

said cam means comprises a diametrically reduced eccentric portion which is interposed between a pair of formal diameter portions of said mandrel to define an engaging groove substantially around said eccentric portion, and said engaging means comprises an inwardly directed arcuate projection which is engageable into said engaging groove.

2. The mounting structure as defined in claim 1, wherein a cross-sectional circle provided by said eccentric portion is internally tangent to that provided by said normal diameter portions.

3. The mounting structure as defined in claim 1, wherein said arcuate projection internally provides a curvature which is equal to that provided by said normal diameter portions.

4. The mounting structure as defined in claim 1, wherein each of said joining end walls is provided with a pair of guide holes into which a pair of guide rods slidably fit.

5. The mounting structure as defined in claim 1, wherein said holder has a bottom end wall which is internally formed with a conical guide surface, and said mandrel has a tapered head at its upper end.

6. The mounting structure as defined in claim 1, wherein said elastic means comprises a rubber ring which is fitted in circumferential groove formed externally on said holder.

7. A structure for mounting mandrels in tube expanding apparatus comprising a vertically movable slide, and a horizontal mounting plate fixed to the underside of said slide and having a plurality of passage holes through which said mandrels suspendingly extend, said structure comprising:

a holder non-fixedly provided on said mounting plate above each passage hole and having an internal gripping space for holding each mandrel in an upper end region thereof;

said holder comprising a pair of cylinder halves movable toward and away from each other and each having a pair of joining end walls;

elastic means for exerting a contractive force on said cylinder halves so that said cylinder halves are moved toward each other into a joined state;

said mandrel being provided in said upper end region with cam means which acts to move said cylinder halves away from each other against the contractive force of said elastic means when said mandrel is rotated relative to said holder;

one of said cylinder halves being internally provided with engaging means which engages with said mandrel at said cam means but disengages therefrom when said cylinder halves are moved away from each other;

said holder is loosely housed in an accommodating bore which is formed in the wall thickness of said mounting plate coaxially with and above said passage hole, and said accommodating bore being in communication with said passage hole and having a diameter larger than that of said passage hole.

8. A structure for mounting mandrels in tube expanding apparatus comprising a vertically movable slide, and a horizontal mounting plate fixed to the underside of said slide and having a plurality of passage holes throught which said mandrels suspendingly extend, said structure comprising:

a holder non-fixedly provided on said mountiong plate above each passage hole and having an internal gripping space for holding each mandrel in an upper end region thereof;

said holder comprising a pair of cylinder halves movable toward and away from each other and each having a pair of joining end walls;

elastic means for exerting a contractive force on said cylinder halves so that said cylinder halves are moved toward each other into a joined state;

said mandrel being provded in said upper end region with cam means which acts to move said cylinder halves away from each other against the contractive force of said elastic means when said mandrel is rotated relative to said holder;

one of said cylinder halves being internally provided with engaging means which engages with said mandrel at said cam means but disengages therefrom when said cylinder halves are moved away from each other; and each of said cylinder halves has a top end wall formed wiht an upwardly directed central projection which is fittable into a longitudinal groove provided in the underside of a horizontal abutment plate interposed between sid slide and said mounting plate.

9. The mounting structure as defined in claim 8, wherein said abutment plate is provided with a blind hole into which the upper end of said mandrel is fitted while said central projection is fitted in said longitudinal groove.

10. The mounting structure as defined in claim 8, wherein said abutment plate is movable transversely of said longitudinal groove.

11. A structure for mounting mandrels in tube expanding apparatus comprising a vertically movable slide, and a horizontal mounting plate fixed to the underside of said slide and having a pluarality of passage holes through which said mandreals suspendingly extend, said structure comprising;

a holder non-fixedly provided on said mounting plate above each passage hole and having an internal gripping space for holding each mandrel in an upper end region thereof;

said holder comprising a pair of cylinder halves movable toward and away from each other and each having a pair of joining end walls;

elastic means for exerting a contractive force on said cylinder halves so that said cylinder halves are moved toward each other into a joined state;

said mandrel being provided in said upper end region with cam means which acts to move said cylinder halves away from each other against the contractive force of said elastic means when said mandrel is rotated relative to said holder;

one of said cylinder halves being internally provided with engaging means which engages with said mandrel at said cam means but disengages therefrom when said cylinder halves are moved away from each other; and each of said cylinder halves has a top end wall formed with a central groove into which is fittable a longitudinal projection provided on the underside of a horizontal abutment plate interposed between said slide and said mounting plate.

* * * * *